US010655375B2

(12) United States Patent
Glogovsky et al.

(10) Patent No.: US 10,655,375 B2
(45) Date of Patent: May 19, 2020

(54) SECURITY SAFE HINGE

(71) Applicant: Alpha Guardian, Las Vegas, NV (US)

(72) Inventors: Rich Glogovsky, Libertyville, IL (US); Ryan Lundberg, Park Ridge, IL (US); John F. Hetzel, Vernon Hills, IL (US)

(73) Assignee: Alpha Guardian, Las Vegas, NV (US)

( * ) Notice: Subject to any disclaimer, the term of this patent is extended or adjusted under 35 U.S.C. 154(b) by 100 days.

(21) Appl. No.: 15/966,434

(22) Filed: Apr. 30, 2018

(65) Prior Publication Data

US 2019/0218839 A1 Jul. 18, 2019

Related U.S. Application Data

(60) Provisional application No. 62/618,750, filed on Jan. 18, 2018.

(51) Int. Cl.
*E05D 7/14* (2006.01)
*E05G 1/026* (2006.01)

(52) U.S. Cl.
CPC ..... *E05D 7/14* (2013.01); *E05G 1/026* (2013.01); *E05D 2700/04* (2013.01)

(58) Field of Classification Search
CPC .. E05D 3/02; E05D 7/14; E05D 7/081; E05D 5/00; E05D 11/06; E05D 11/1014; E05D 2700/04; E05G 1/026; E05Y 2900/132; B65D 90/00
USPC ..... 109/59 R, 59 T, 64, 73; 16/375, 387
See application file for complete search history.

(56) References Cited

U.S. PATENT DOCUMENTS 1,048,038 A * 12/1912 Cerny ..... E05D 3/02 49/398
2,709,276 A 5/1955 Stein
2,881,543 A * 4/1959 De Rouen ..... A63B 71/0672 40/598
3,233,340 A * 2/1966 Brown ..... A63F 1/06 434/129
3,249,074 A * 5/1966 Deaton ..... E05G 1/026 109/76
3,950,818 A * 4/1976 Holmes ..... E05D 11/1014 16/296
5,685,046 A * 11/1997 Neag ..... E05D 3/127 16/366
5,931,104 A 8/1999 Horn et al.
5,971,515 A * 10/1999 Baker ..... E05D 5/065 312/329

(Continued)

FOREIGN PATENT DOCUMENTS

EP 2130996 * 12/2009
EP 2540941 * 1/2013
EP 2781676 * 9/2014

*Primary Examiner* — Suzanne L Barrett
(74) *Attorney, Agent, or Firm* — Woodard, Emhardt, Henry, Reeves & Wagner, LLP; Charles Meyer

(57) ABSTRACT

A hinge arrangement for a safe or similar secure storage unit. A unit includes a compartment with an opening in which a door can be mounted. Hinge cups are arranged along one edge of the door frame. Hinge lug pieces extend from an edge of the door and are received within the hinge cups. Hinge pins are introduced into the cups and lugs, creating a pivot joint for each hinge. The hinge pin passages are concealed from the exterior and are only accessible from the interior of the storage compartment. When closed, the hinge lug pieces are preferably substantially flush with the exterior surfaces of the door frame.

20 Claims, 12 Drawing Sheets

(56) References Cited

U.S. PATENT DOCUMENTS

| | | | | |
|---|---|---|---|---|
| 6,000,348 | A | 12/1999 | Do | |
| 6,293,207 | B1 | 9/2001 | Do | |
| 7,159,767 | B2 | 1/2007 | McCracken et al. | |
| 7,350,470 | B1 * | 4/2008 | Stuhlbarg | E05D 7/14 109/73 |
| 7,404,363 | B2 | 7/2008 | Dunstan | |
| 7,641,106 | B1 * | 1/2010 | Kovacs | G06Q 40/02 109/59 R |
| 7,793,600 | B2 | 9/2010 | Dunstan | |
| 7,836,555 | B2 * | 11/2010 | Wildman | E05D 5/065 109/74 |
| 8,443,738 | B2 | 5/2013 | James et al. | |
| 8,671,521 | B2 * | 3/2014 | Irwin | E05D 3/12 16/308 |
| 9,140,049 | B2 | 9/2015 | Suggs | |
| 9,732,549 | B2 * | 8/2017 | Chow | E05D 7/14 |
| 2008/0276424 | A1 * | 11/2008 | Gunderson | E05F 1/061 16/286 |
| 2014/0298616 | A1 * | 10/2014 | Baer | E05D 3/02 16/250 |
| 2015/0366344 | A1 | 12/2015 | Suggs | |
| 2016/0369542 | A1 * | 12/2016 | Bacchetti | E05D 3/02 |
| 2017/0321462 | A1 | 11/2017 | MacDonald | |

* cited by examiner

SECURITY SAFE HINGE

FIELD OF THE DISCLOSURE

A hinge arrangement for a safe or similar secure storage unit.

BACKGROUND

Secure storage units such as safes, gun cabinets or comparable security cabinets are often used to store valuables such as cash, jewels, important documents and firearms. The safes preferably help protect the contents from theft, fire or unauthorized access, often in residential or business settings. A typical unit includes a body or cabinet assembly defining a storage compartment with an opening selectively covered by a hinged door. As will be understood, the cabinet assembly and door are frequently made of high strength and durable materials.

In certain variations storage units such as floor safes or stand-alone safes may be portable or semi-portable, meaning that they are not permanently built into the infrastructure of a building and potentially can be moved with sufficient effort. In other arrangements, the safes are mounted to the structure as fixtures or installed or built-in to substantially permanent aspects of the building, such wall-safes or safes embedded in built-in cabinet units. Typically the safe door has a lock or locking mechanism which can be locked or unlocked using an access mechanism to allow authorized individuals access to the interior of the safe. Example access mechanisms may require keys, entry of a manual combination, entry of an electronic combination, biometrics such as fingerprint scans, use of a magnetic strip, dual authentication protocols or similar access controls. Operation of the lock via the access mechanism may include a relatively simple rotating hook and post arrangement or more complex arrangements. For example, the safe may incorporate slidable retaining rods which extend to interlock the door to the cabinet when engaged.

Preventing tampering and unauthorized access is an important goal for making such safes secure. To assist that goal, the hinge arrangement for the door preferably is tamper-resistant. One approach to enhance the security of the hinge is to make the hinge pivot mechanism such as the pivot pins inaccessible from the exterior of the safe. However, when an interior pivot pin arrangement is used, it can be difficult to manufacture and assemble and it may limit the extent to which the door can be opened during authorized access. Many arrangements limit rotation of the door to ninety degrees or less. Further, in many arrangements the safe door is biased to a closed position, which can be unwieldy and awkward to hold open during use.

It is desirable to provide a secure storage unit hinge arrangement which maximizes security while also promoting ease of use.

SUMMARY

Representative embodiments provide a security safe or a similar secure storage unit. An example unit includes a compartment with an opening in which a door can be mounted. A pair of hinge cups are arranged along one edge of the door frame. A pair of hinge lug pieces extend from an edge of the door. The hinge lug pieces are received within the corresponding hinge cups. With the hinge lugs in the hinge cups, hinge pins are introduced into aligned passages in the cups and lugs, creating a pivot joint for each hinge.

The hinge pin passages are concealed from the exterior and are only accessible from the interior of the storage compartment. When closed, the hinge lug pieces are preferably substantially flush with the exterior surfaces of the door frame.

In some embodiments, a hinge lug has a pentagonal profile, with two interior sides and an exterior defined by an outer side, a forward side and an angled side extending between the outer side and the forward side. The angled side defines an angled or beveled corner aspect. The angled side allows the hinge lug and thus the door to rotate within a span of at least 180 degrees relative to the door frame. In certain embodiments, the door can pivot more than 180 degrees, for example allowing a rotational range of approximately 190 degrees or more.

In certain embodiments the hinge assembly optionally incorporates a retention mechanism. The retention mechanism yieldingly and selectively holds the open door in place at certain angular orientations, inhibiting unintended movement of the door. When sufficient force is applied, the retention force can be overcome, allowing the hinge and door to rotate as desired.

Further forms, objects, features, aspects, benefits, advantages, and examples of the present disclosure will become apparent from a detailed description and drawings provided herewith.

DESCRIPTION OF SELECTED EXAMPLES

Figure 1:
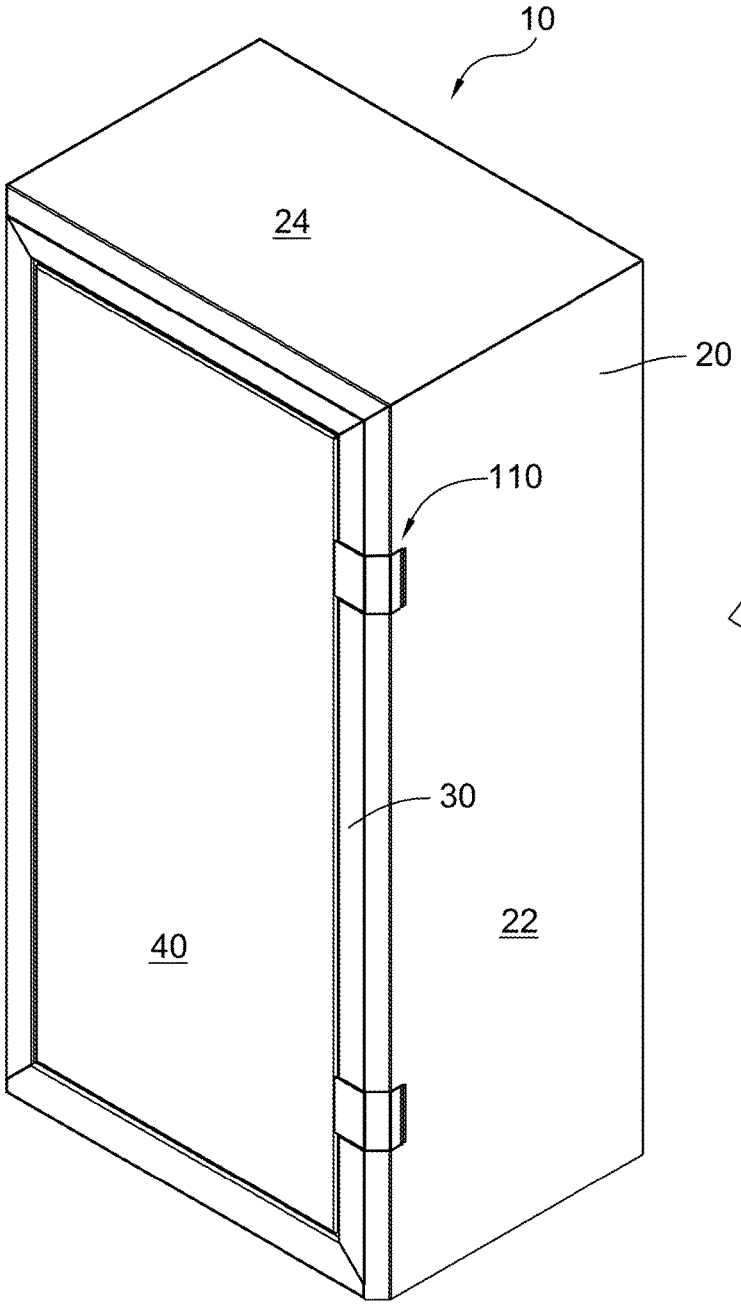
FIG. 1 is a perspective view of safe with a hinge according to a representative embodiment.

For the purpose of promoting an understanding of the principles of the disclosure, reference will now be made to the examples illustrated in the drawings and specific language will be used to describe the same. It will nevertheless be understood that no limitation of the scope of the disclosure is thereby intended. Any alterations and further modifications in the described examples, and any further applications of the principles of the disclosure as described herein are contemplated as would normally occur to one skilled in the art to which the disclosure relates. Certain examples of the disclosure are shown in detail; although it will be apparent to those skilled in the relevant art that some features which are not relevant to the present disclosure may not be shown for the sake of clarity.

Representative embodiments provide a security safe or a similar secure storage unit. A typical unit includes a storage compartment with an opening to which a door is mounted. In the illustrated embodiment, a pair of hinge cups are arranged along one edge of the door frame. A matching pair of hinge lug pieces extend from an edge of the door. The hinge lug pieces are received within the corresponding hinge cups. With the hinge lugs in place in the hinge cups, hinge pins are arranged in aligned passages in the cups and lugs, creating a pivot joint for each hinge. The hinge pin passages are concealed from the exterior and are only accessible from the interior of the storage compartment. When closed, the hinge lug exterior surfaces are preferably substantially flush with the exterior surfaces of the door frame. Preferably the hinge assembly enables the door to rotate within a span of at least 180 degrees relative to the door frame. In certain embodiments, the door can rotate in a rotational range greater 180 degrees, for example with a rotational range of approximately 190 degrees or more.

In some embodiments, the hinge lug has a pentagonal profile, with two interior sides and an exterior defined by an outer side, a forward side and an angled side extending between the outer side and the forward side. The angled side defines an angled or beveled corner aspect. The angled side allows the hinge lug and thus the door to rotate within a span of at least 180 degrees relative to the door frame. In certain embodiments, the angled side allows the lug and door to pivot more than 180 degrees, for example allowing a rotational range of approximately 190 degrees or more.

In certain embodiments the hinge arrangement incorporates an optional retention mechanism. The retention mechanism yieldingly and selectively holds the open door in place at certain angular orientations, inhibiting unintended movement of the open door. When sufficient force is applied, the retention force can be overcome, allowing the hinge and door to rotate as desired.

Figure 1A:
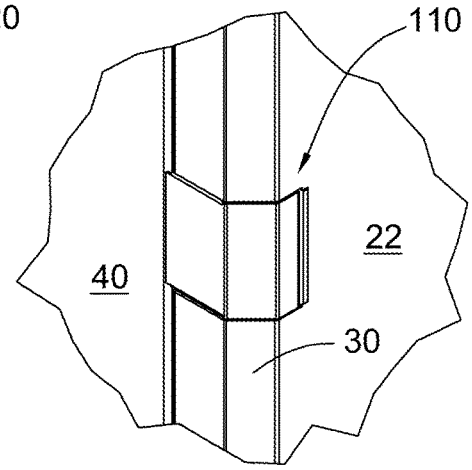
FIG. 1A is an enlarged partial view of a hinge of FIG. 1.

Representative embodiments provide a security safe or a similar secure storage unit 10. As illustrated with a representative example in FIG. 1, a typical unit 10 includes a body assembly 20 forming a storage compartment or cabinet with an opening in which a door 40 is mounted. A common body assembly arrangement includes a right side 22, a top side 24, a left side 26, a lower side 28, a rear side and an open front. An exterior enlarged view of a hinge arrangement 110 according to a disclosed embodiment is illustrated in FIG. 1A. The body assembly sides can be integral such as bent sheets or individual panels assembled by welding or using other fasteners. Alternately, one or more sides can be formed using building fixtures such as walls. Directional references herein are for ease of illustration. The present disclosure is not limited to a front opening safe. An alternate arrangement includes left and right sides, front and rear sides, a lower side and an open top with a hinged cover.

The body assembly 20 and door 40 are frequently made of high strength and heavy materials which may also be fire resistant. The unit 10 usually will typically include a handle, a locking mechanism and an access mechanism, which are considered conventional for purposes of the present disclosure, and which are not shown for ease of illustration.

A frame 30 may be mounted to or formed by the front edges of the body assembly 20. Frame 30 may have a width that protrudes or extends inward to an inner edge as a casing from the perimeter of the front edges of right side 22, top side 24, left side 26, and lower side 28, forming a slightly smaller open front encircled by a lip or flange. In certain embodiments, frame 30 includes an inner side face which extends perpendicularly rearward from the inner edges of frame 30. An open area may be defined behind the inner edges of frame 30. In the closed position the perimeter of door 40 is seated in and surrounded by frame 30, with the outer face of door 40 substantially flush with or slightly inset relative to the front of frame 30.

Figure 2:
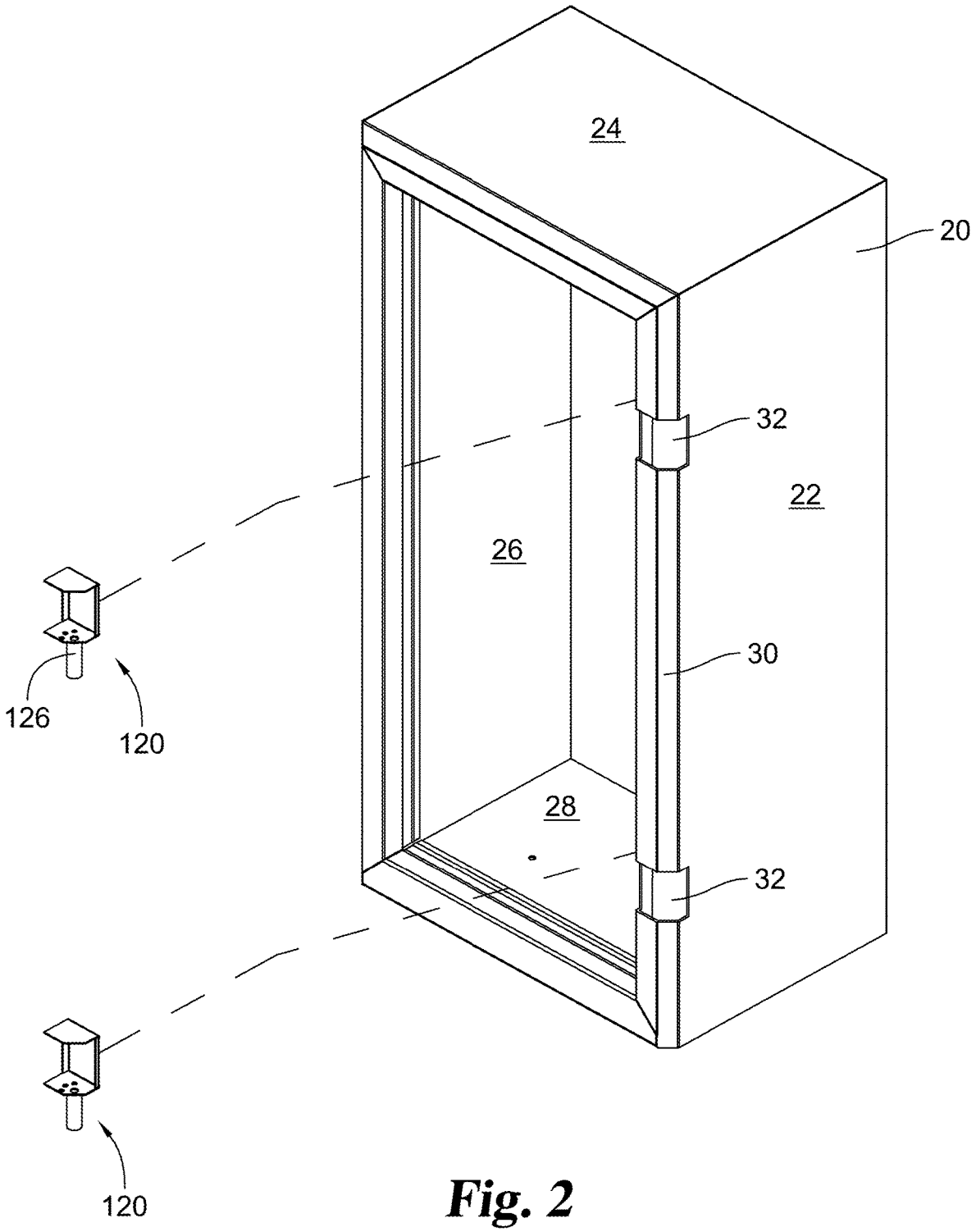
FIG. 2 is a perspective exploded view of the body assembly and hinge cups according to the embodiment of FIG. 1.

Illustrated in further detail in FIG. 2, a pair of hinge cup cavities 32 may be formed in frame 30. In the illustrated example, hinge cup cavities 32 are defined along the forward edge of right side 22, for instance in frame 30. The cavities are formed with an open front and open sides, and are also partially accessible from the interior of body assembly 20. The cavities may be formed during initial manufacture of frame 30, or of right side 22 or created later, for example using a cutting tool.

Hinge cup cavities 32 are sized to fittingly receive a corresponding pair of hinge cups 120. In some embodiments, hinge cups 120 are emplaced by orienting them within the interior of body assembly 20 behind frame 30 and moving them forward to engage hinge cup cavities 32. The hinge cups may extend partially behind the frame into the interior of body assembly 20. The hinge cups 120 preferably are permanently mounted within hinge cup cavities 32, for example by welding. Alternately, other arrangements such as fasteners may be used. Such arrangements must provide a secure connection and should not interfere with the operation of hinge arrangement 110. Each hinge cup includes cylinder 126 defining a passage for a hinge pin wherein the hinge pin passage is only accessible from the interior of body assembly 20. In certain embodiments, the cylinder 126 is located in the interior area of body assembly 20 behind frame 30. The hinge pin passage is vertical and opens downward. The hinge pin passage opening can only be accessed from the interior of body assembly 20, for instance by reaching around and behind frame 30.

Figure 3A:
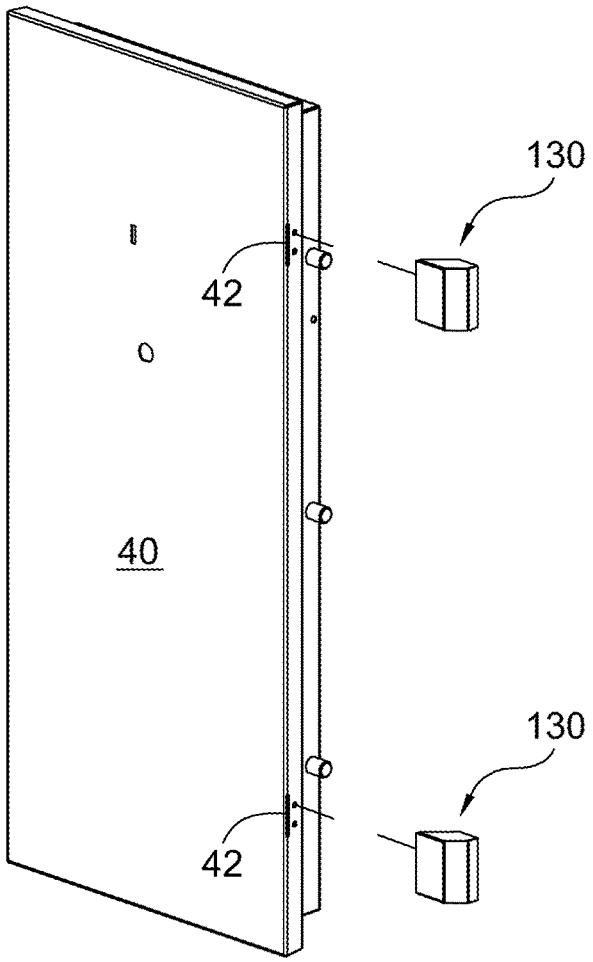
FIGS. 3A and 3B illustrate exploded and assembled view of the door and hinge lugs illustrated in FIG. 1.
Figure 3B:
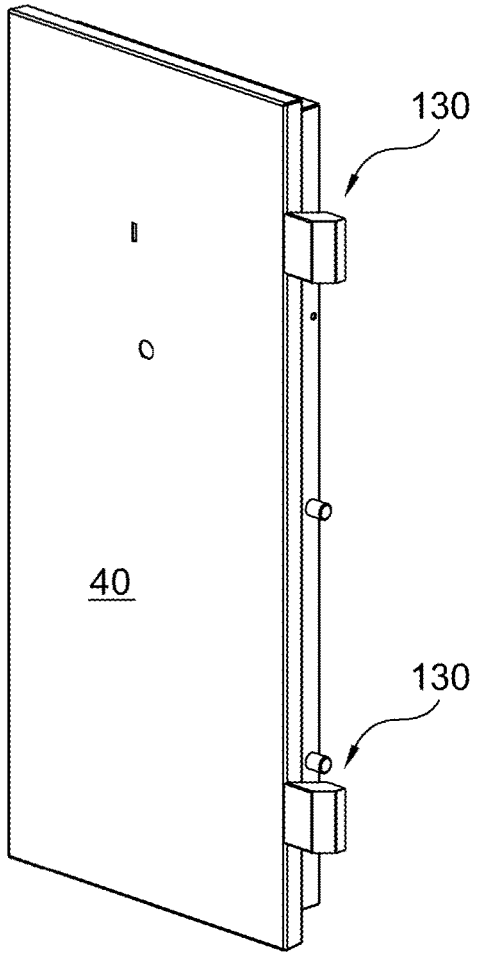
Figure 6A:
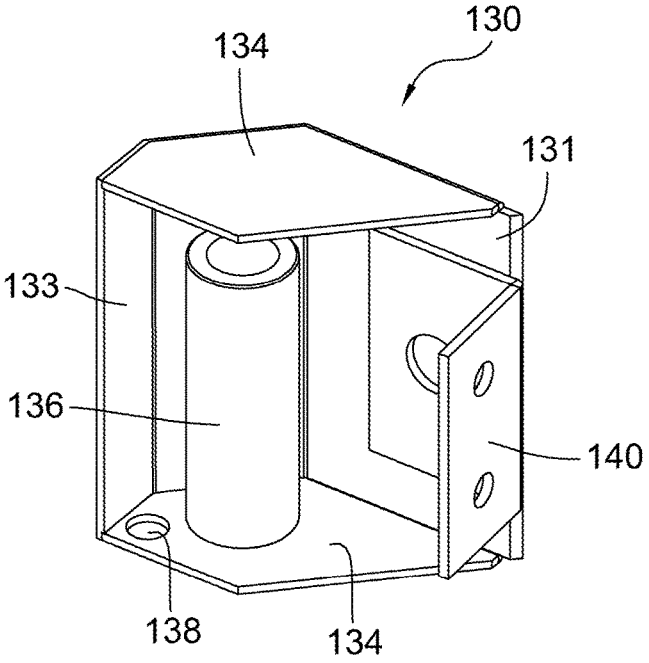
FIGS. 6A-D illustrate a hinge lug usable in the embodiment illustrated in FIG. 1.
Figure 6B:
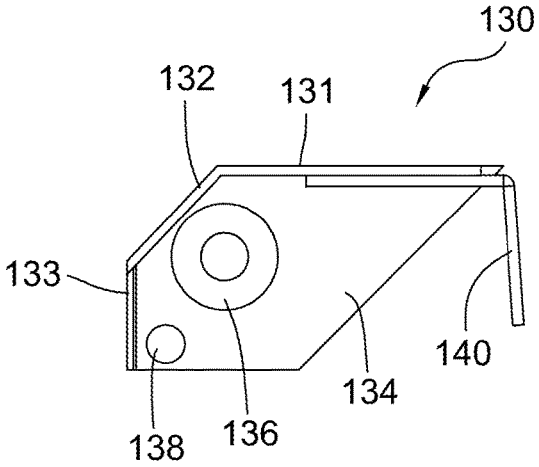

FIGS. 3A and 3B illustrate a pair of hinge lug pieces 130 which extend from an edge of the door 40. In the illustrated example, the right edge of door 40 is used. In the illustrated embodiment, each lug piece 130 includes a mounting bracket 140 (e.g. FIGS. 6A, 8A) which can be secured to a corresponding mounting location 42 on the door edge. The mounting brackets 140 may be secured with fasteners such as screws or bolts or may be welded in place. Each lug piece 130 includes an internal cylinder 136 defining a hinge pin passage.

Figure 4:
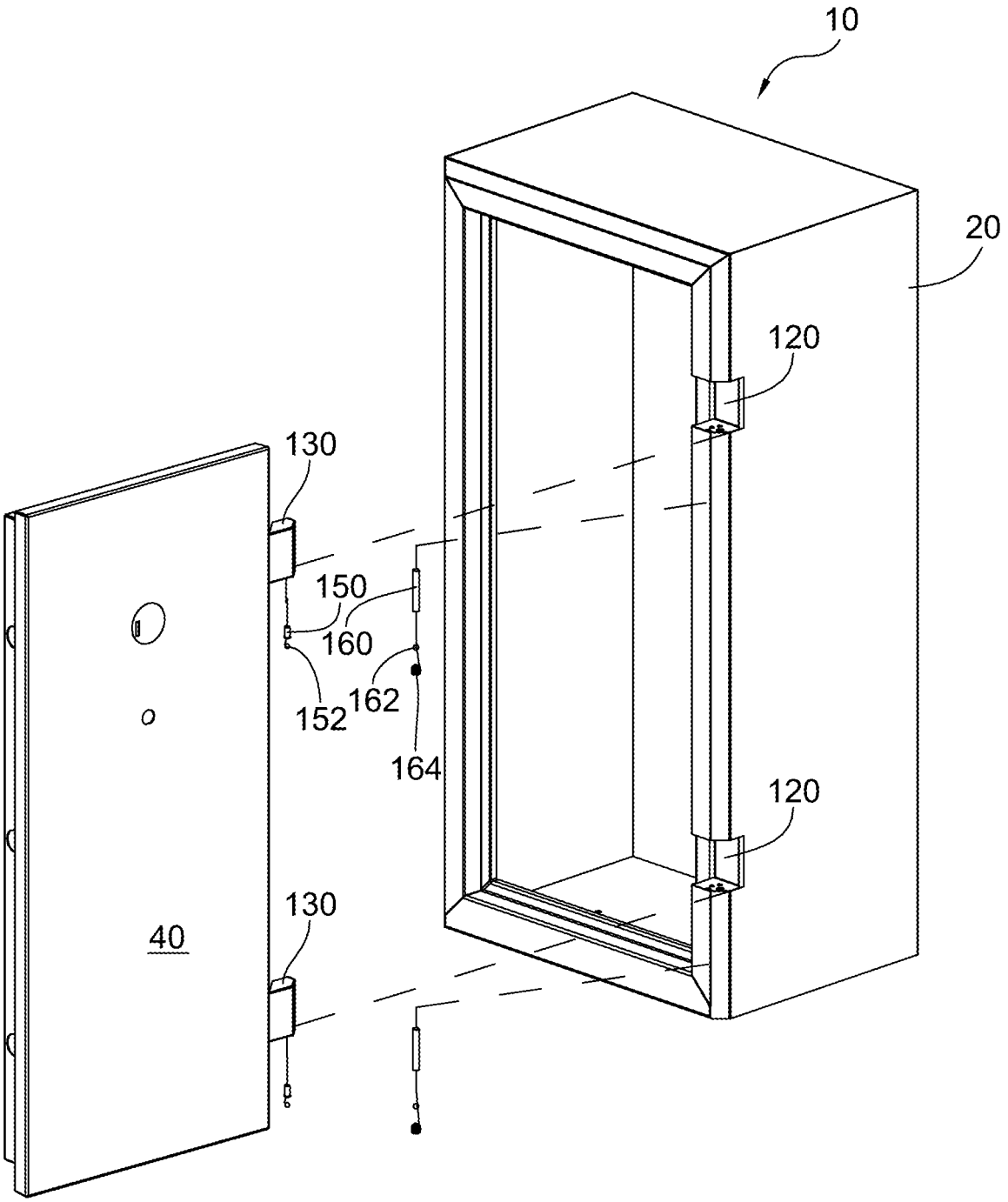
FIG. 4 is a partially exploded view of the door and body assembly illustrated in FIG. 1.

Assembly of the door 40 to body assembly 20 is illustrated in FIG. 4. The hinge lug pieces 130 are sized and spaced to be received within the corresponding hinge cups 120. When properly placed, the lug hinge pin passages are axially aligned with the hinge cup pin passages. With the hinge lugs 130 in place in the hinge cups 120, hinge pins 160 can be introduced into the aligned passages in the cups and lugs, creating a pivot joint hinge. For instance, the hinge pins 160 can be advanced in an upward direction from the lower end of hinge cup cylinder 126 a sufficient distance until the hinge pin length overlaps both a lug cylinder 136 and a hinge cup cylinder 126. Each hinge pin 160 can then be secured in place, for example with a set screw 164 threaded into the lower opening of hinge cup cylinder 126. Optionally, to facilitate ease of rotation, a ball bearing 162 can be arranged between the upper end of set screw 164 and the lower end of hinge pin 160. The resulting assembly is an interior hinge which conceals the hinge pin within the frame and walls of the assembly body.

When door 40 is closed, the exterior sides of hinge lug piece 130 are preferably substantially flush or only minimally protrude from the exterior surfaces of the door frame 30 with minimal clearance to prevent tampering. In certain embodiments frame 30 defines a profile which includes three exterior sides which match the profile of the three exterior sides of hinge lug piece 130.

Figure 5:
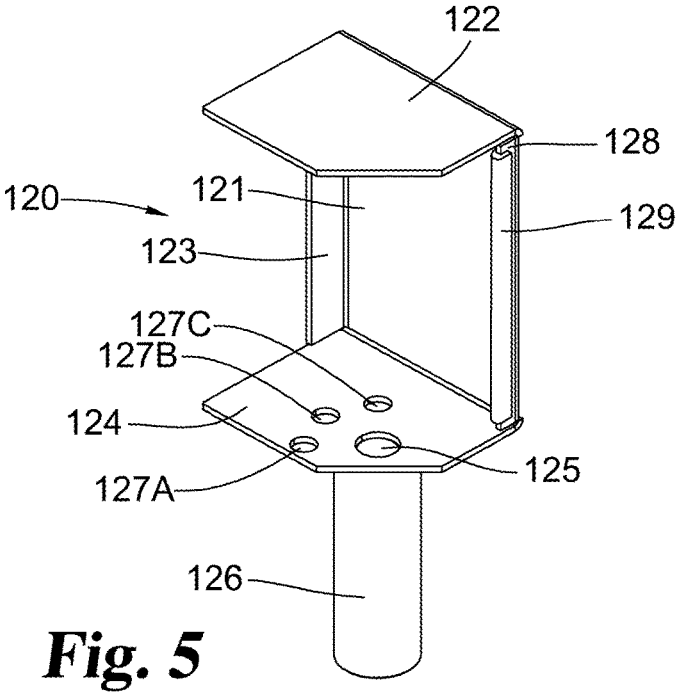
FIG. 5 is a perspective view of a hinge cup usable in the embodiment illustrated in FIG. 1.

In further detail, a perspective view of a hinge cup 120 is shown in FIG. 5. Hinge cup 120 includes a rear wall 121, from which forwardly extends a planar upper wall such as upper plate 122 and a parallel planar lower wall such as lower plate 124. A hinge pin opening 125 is defined in lower plate 124, with cylinder 126 extending downward from lower plate 124. The interior bore of cylinder 126 defines a hinge pin passage with an open lower end. When hinge assembly 110 includes certain embodiments of a retention mechanism, a series of retention openings 127A-C are defined in an upward facing surface of lower plate 124. In certain embodiments, upper plate 122 and lower plate 124 each have a substantially pentagonal profile with two interior sides or edges. The three exterior sides/edges define an exterior profile which at least matches the cross-sectional exterior profile of frame 30 and the profile of the exterior sides of the corresponding hinge lug piece.

An inner vertical flange 123 may extend forward from an inner edge of rear wall 121 and an outer vertical flange 128 may extend forward from an outer edge of rear wall 121. Inner and outer vertical flanges 123, 128 define stops, limiting rotation of hinge lug piece 130 in the hinge assembly 110. An optional resilient bumper 129 may be mounted on outer vertical flange 128 to dampen the lug rotation force and for sound dampening. Plates 122 and 124 and flanges 123 and 128 are each substantially perpendicular to rear wall 121. Flanges 123 and 128 are also substantially perpendicular to upper plate 122 and lower plate 124.

Figure 6C:
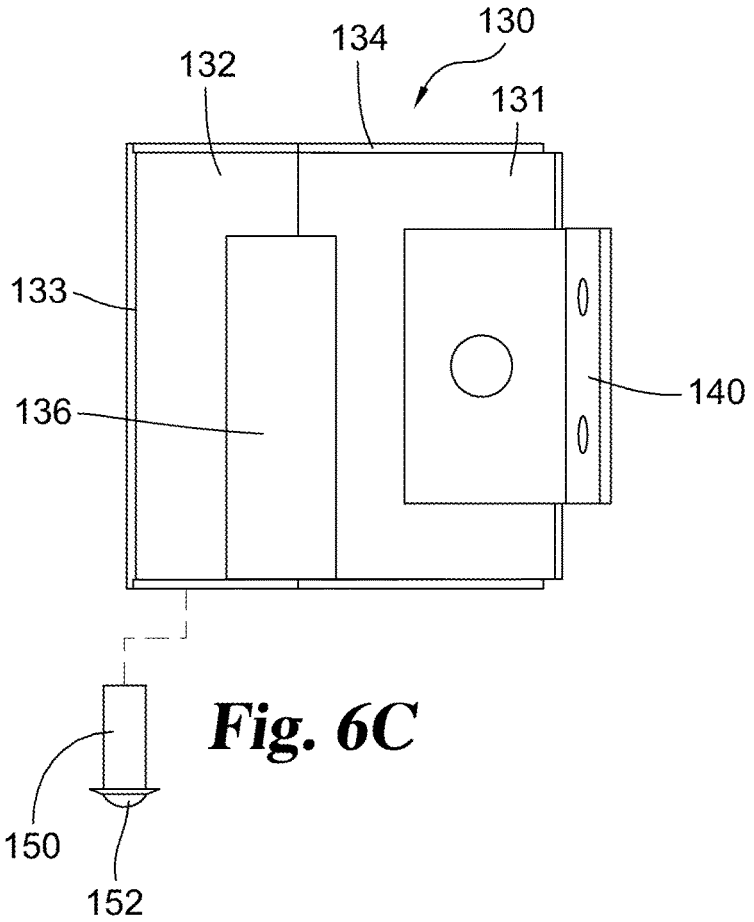
Figure 6D:
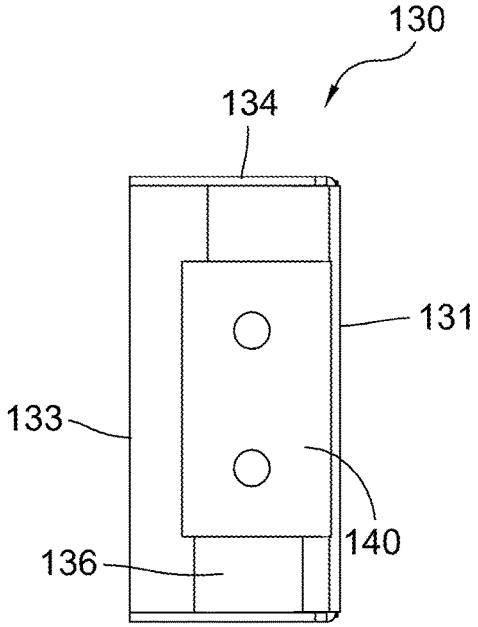
Figure 7A:
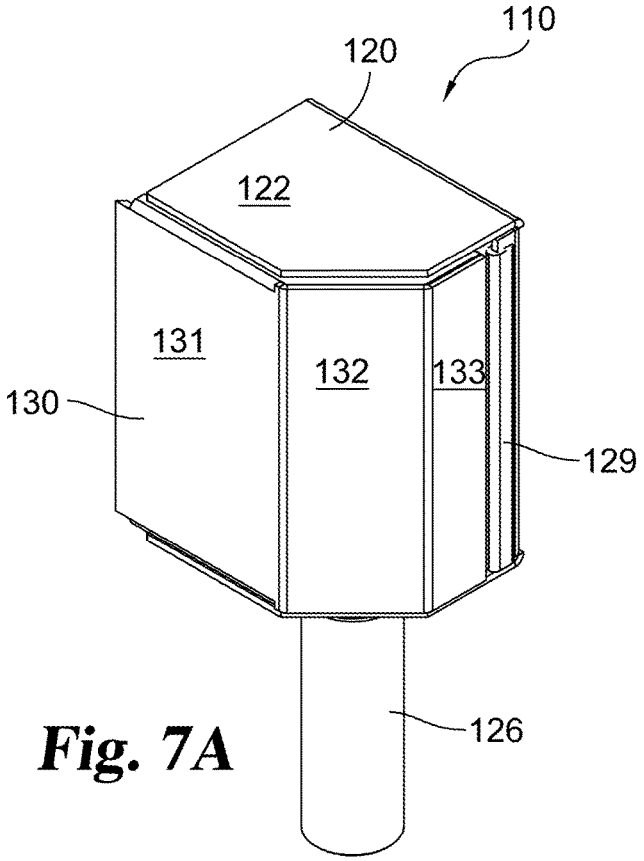
FIG. 7A is a perspective view of the hinge assembly illustrated in FIG. 1 in the closed position.

Views of a hinge lug piece 130 are illustrated in FIGS. 6A-D. Hinge lug piece 130 includes a somewhat cup shaped hollow body with three exterior sides including a forward exterior side 131, an outer exterior side 133 and an angled exterior side extending between forward exterior side 131 and outer exterior side 133. The angled exterior side 132 defines an angled or beveled corner aspect. In alternate embodiments, angled exterior side 132 may have other profiles, such as a curve. As seen in FIG. 7A and in contrast to a round or partially rounded hinge lug, preferably the surface of the exterior profile is adjacent to the hinge pocket and flush with the surrounding surfaces when closed and does not significantly curve inward. For instance outer exterior side 133 is adjacent to hinge cup 120 and particularly flange 128 in the closed position. A minimal gap between outer exterior side 133 and hinge cup 120 is desired to prevent the insertion of and/or to minimize the potential purchase area for tools that might be used to attempt to obtain unauthorized access. Exterior side 133 may be finished with a blunt edge for safety, which is not considered a curve.

An upper horizontal pentagonal shaped plate 134 extends from and connects the upper edges of the three exterior sides. A parallel lower pentagonal shaped plate 134 extends from and connects the lower edges of the three exterior sides. A hinge pin opening (not visible) is defined in lower wall 134, with cylinder 136 extending upward from lower wall 134. The interior bore of cylinder 136 defines a hinge pin passage aligned with the hinge pin opening. When hinge assembly 110 includes certain embodiments of a retention mechanism, an opening 138 for a ball bearing sleeve may be defined in lower wall 134. A representative ball bearing 152 and sleeve 150 are illustrated in FIG. 6C.

Figure 7B:
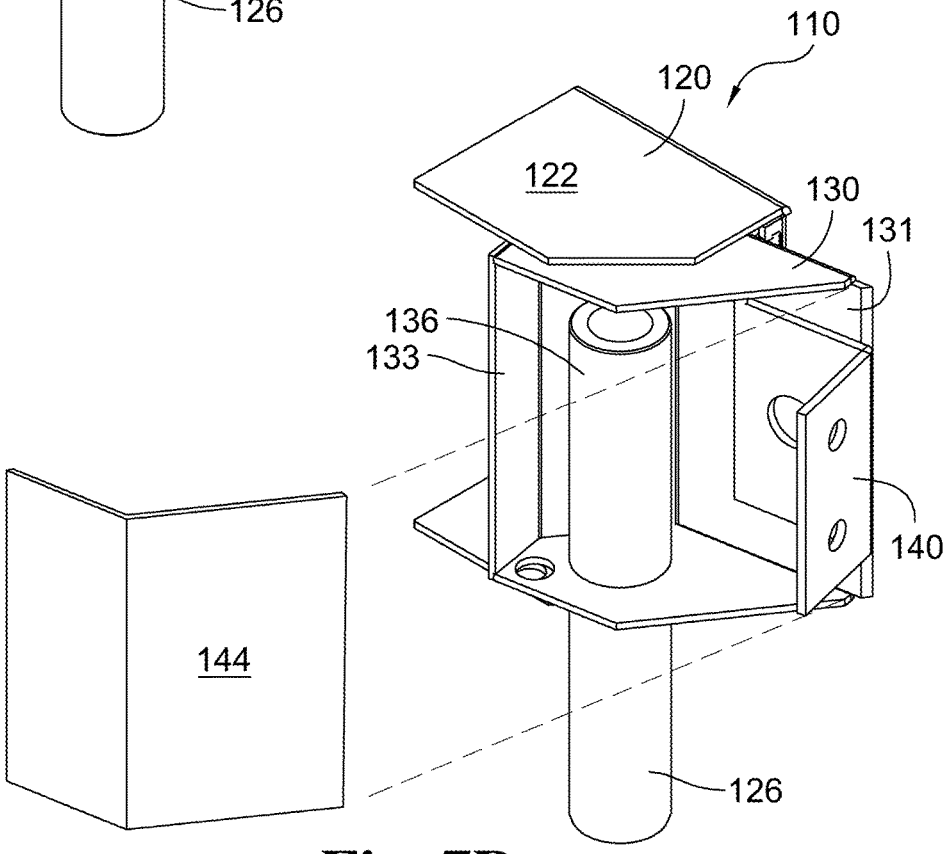
FIG. 7B is a perspective partially exploded view of the hinge assembly of FIG. 1 in the open position.
Figure 7C:
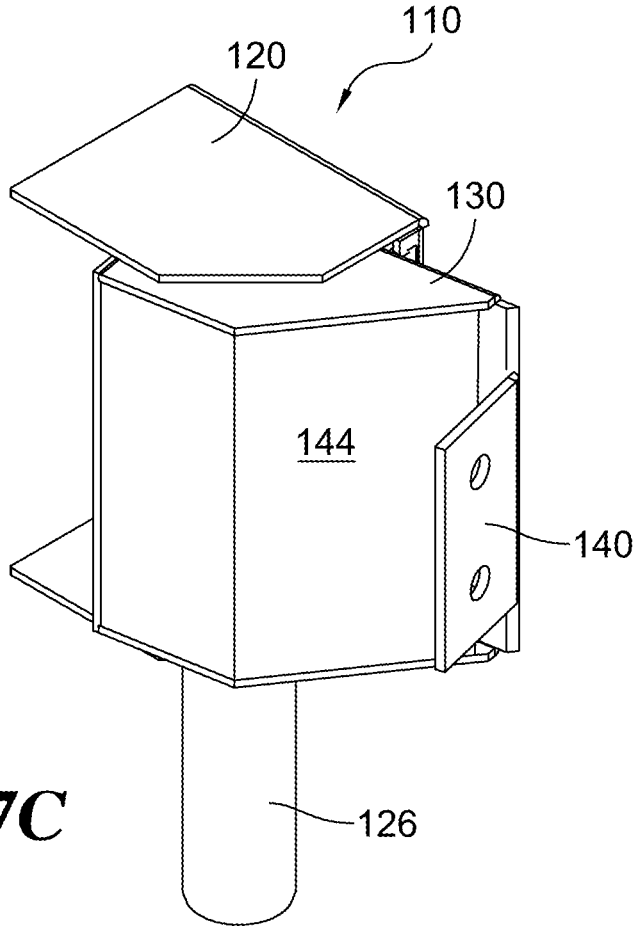
FIG. 7C is a perspective assembled view of the hinge assembly of FIG. 1 in the open position.

An exterior view of hinge assembly 110 is illustrated in FIG. 7A. In certain embodiments the interior of hinge lug piece 130 is covered with a shield 144, illustrated in an exploded view from an interior perspective in FIG. 7B, and illustrated in an assembled view with the hinge assembly 110 in the open position in FIG. 7C. Shield 144 covers a pinch point for safety. Shield 144 may be formed as a plate with two angled surfaces. The upper and lower edges of shield 144 are connected to the inner edges of upper and lower plates 134, for example by welding, fasteners or adhesive. An outer edge of shield 144 is connected adjacent a rearward edge of outer exterior side 133. An inner edge of shield 144 is closely adjacent to the inner edge of forward exterior side 131 and may be connected in place, yet forward exterior side 131 and shield 144 allow clearance for bracket 140 to extend from hinge lug piece 130.

Figure 8A:
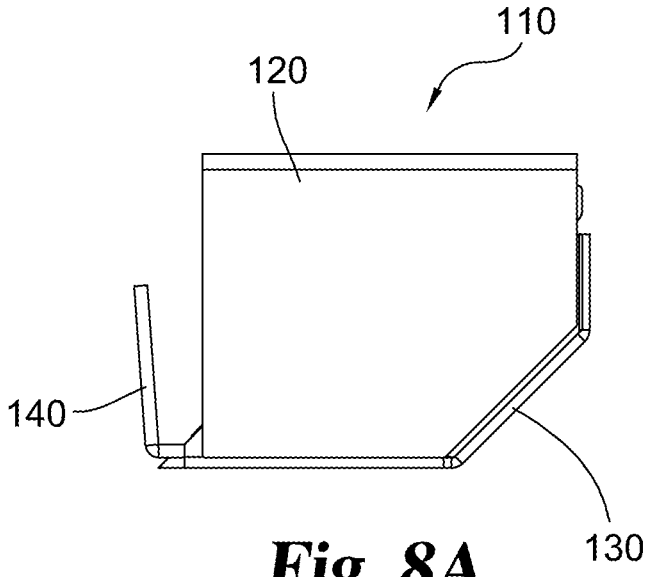
FIG. 8A is a top view of the hinge assembly of FIG. 1 in the closed position.
Figure 8B:
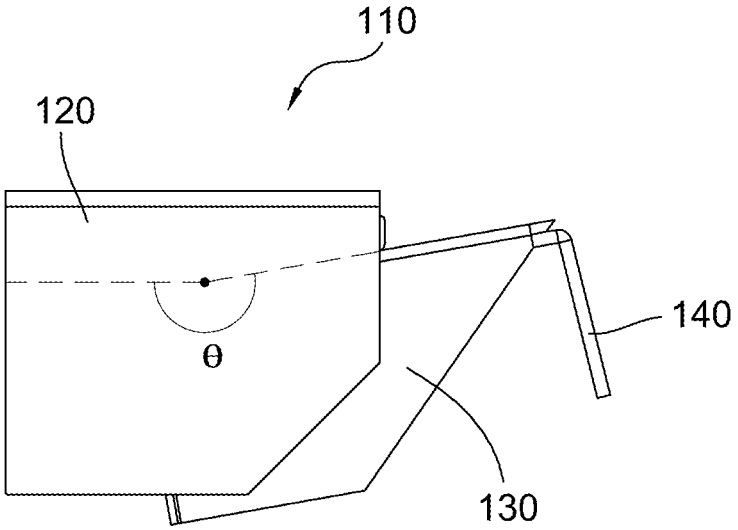
FIG. 8B is a top view of the hinge assembly of FIG. 1 in a fully open position.

FIG. 8A illustrates a top view of hinge assembly 110 in a closed position. Lug piece 130 is substantially received within hinge cup 120. The exterior sides of lug piece 130 are substantially flush with the exterior edges of hinge cup 120. FIG. 8B illustrates a top view of hinge assembly 110 in a fully open position, with lug piece 130 rotated relative to hinge cup 120, and illustrating a rotation angle θ greater than 180 degrees. In the illustrated embodiment, angle θ is approximately 190 degrees. FIG. 8B corresponds to FIG. 9D which illustrates a position where door 40 has been rotated greater than 180 degrees, for example to approximately 190 degrees relative to the opening defined by frame 30. Optionally, door 40 can rotate greater than 190 degrees. As illustrated in FIG. 9D, in this open position the door 40 is arranged adjacent to the right side 22, with door 40 angled slightly rearward.

An aspect illustrated in FIGS. 7A-C and 8A-B is that when hinge lug piece 130 is rotated to its open-most position, the placement and angle of side 132 provides clearance, allowing the angled side 132 to be rotated past vertical flange 128 and bumper 129 without engagement. In some arrangements, the distance between the rotational axis of the hinge pin 160 and the rear wall 121 may be greater than the distance between the rotational axis of the hinge pin 160 and a forward exterior side 131 of the hinge lug piece. In some embodiments, the distance between the rotational axis and the rear wall 121 is measured as the distance between the rotational axis and the forward edge of the vertical flange 128 and/or bumper 129. This assists in allowing greater rotational movement.

In one aspect illustrated in FIG. 5, the rotational axis of the hinge pin passage is arranged forward of rear wall 121, and specifically is spaced forward a distance greater than outer vertical flange 128 extends. Hinge cup 120 defines a laterally open gap in the exterior sides which extends through frame 30 and/or body assembly 20. In operation, this open gap and the forward spacing of the hinge pin passage allows hinge lug piece 130 to rotate past 180 degrees. The angled exterior side 132 of the hinge lug provides clearance, allowing the angled exterior side 132 to rotate past flange 128 without engagement. This assists in allowing greater rotational movement.

Figure 9A:
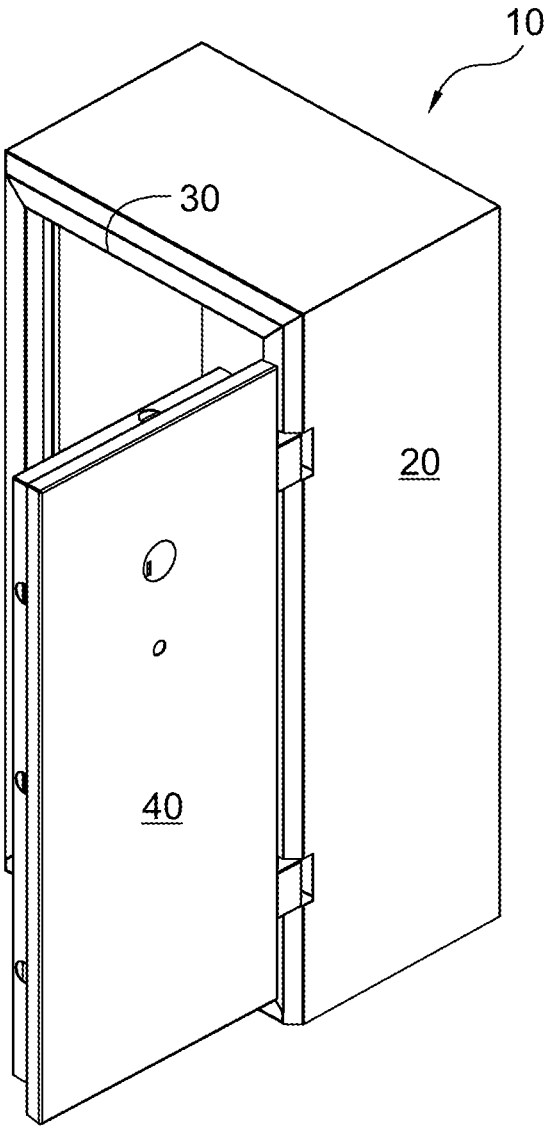
FIGS. 9A-D illustrate angular positions of the open door relative to the body assembly.
Figure 9B:
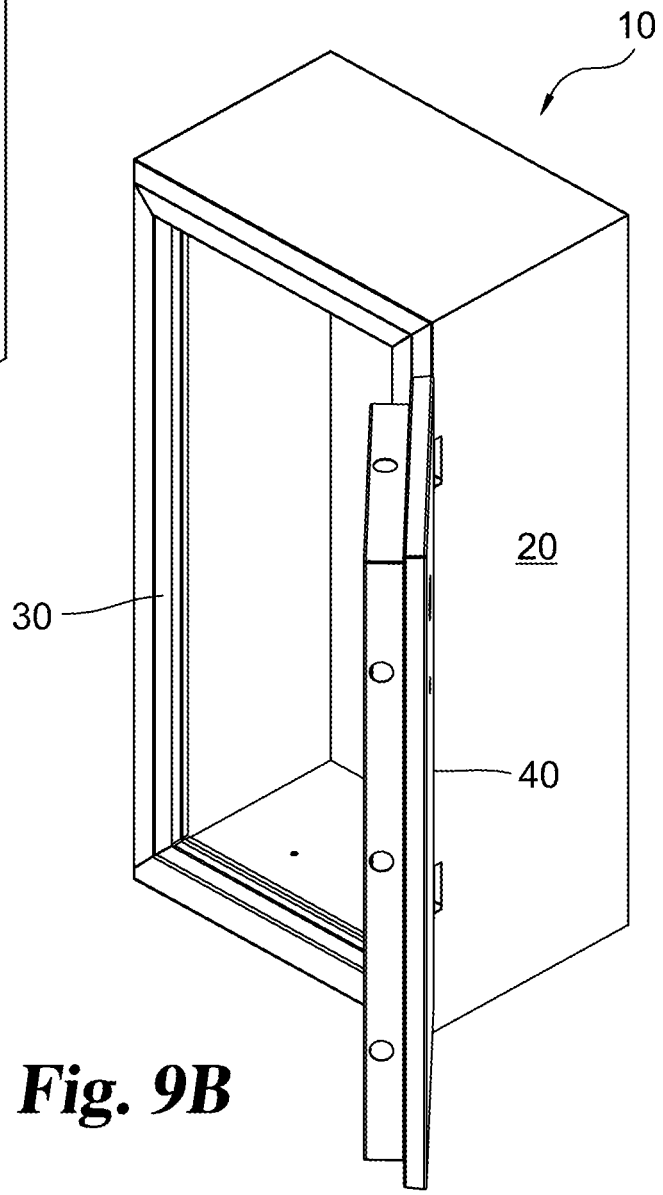
Figure 9C:
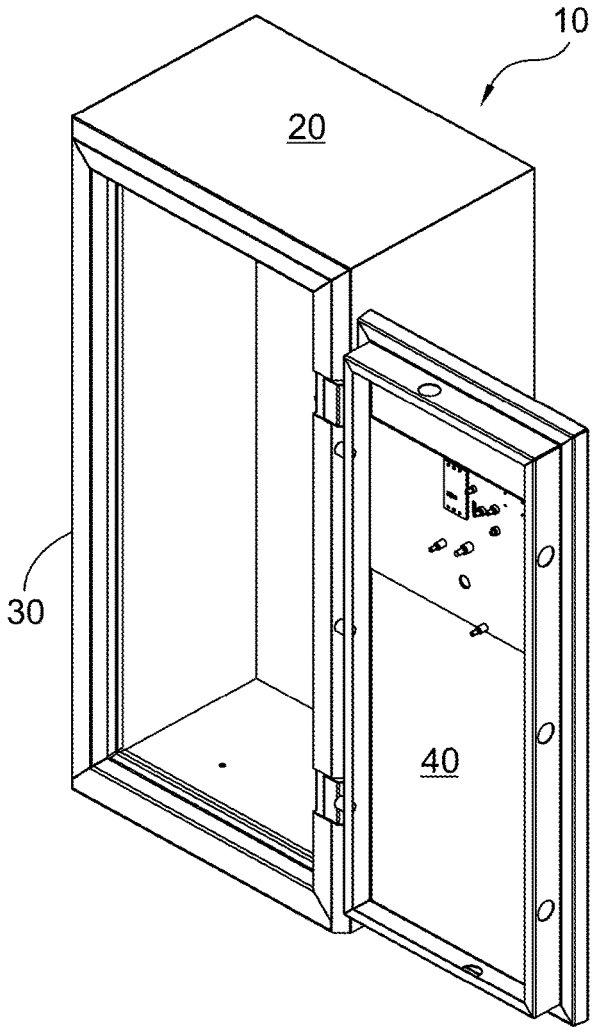
Figure 9D:
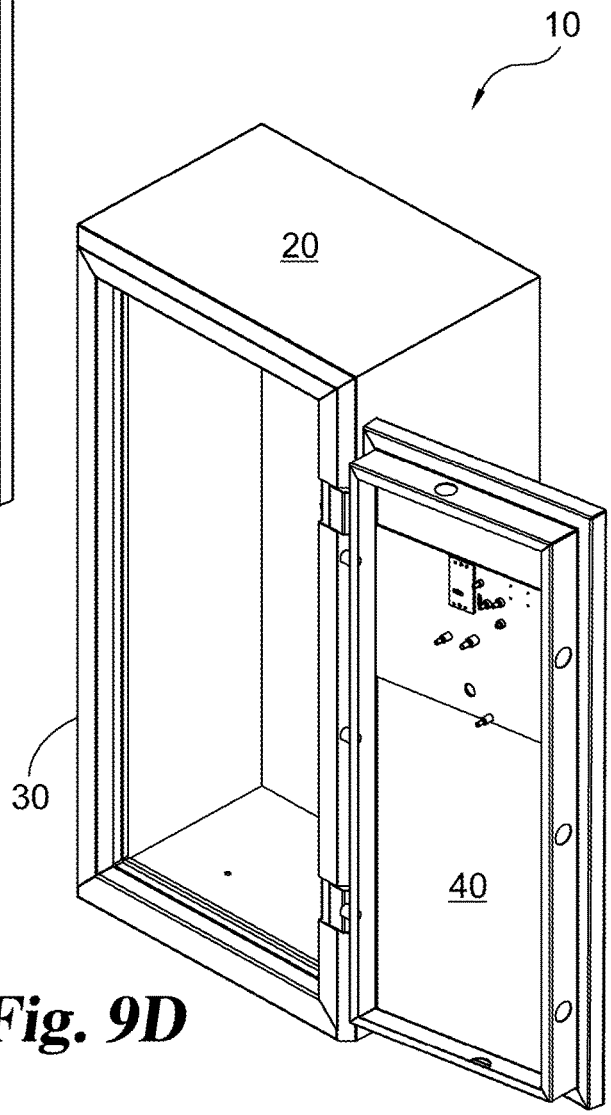

FIGS. 9A-D illustrate example positions of door 40 rotated relative to body assembly 20. FIGS. 9A-C illustrate representative angles where open door 40 can be yieldingly held in place by an optional retention mechanism. FIGS.

9A-C illustrate positions where door 40 is rotated approximately 90 degrees, approximately 135 degrees and approximately 180 degrees relative to a closed position defined by the open front in frame 30.

In selected embodiments, an optional retention mechanism includes a ball bearing 152 or plunger protruding from a lower end of a sleeve 150 mounted in hinge lug piece 130 (See FIG. 6C). The ball bearing 152 operates in conjunction with a series of retention openings 127A-C defined in a corresponding hinge cup 120. Preferably, ball bearing 152 is biased to protrude, for example by a compressible spring located within the interior of sleeve 150. When sufficient pressure is applied, ball bearing 152 can be urged to slightly retract within sleeve 150. A ball bearing and sleeve can optionally be mounted in one or both hinge lugs 130 prior to placing hinge lugs 130 within hinge cups 120. The ball bearing 152 is preferably spaced at a fixed radial distance from the lug hinge pin passage and axis. Correspondingly, hinge cup 120 retention openings 127A-C are arranged in an arc defined at a fixed radius from the hinge cup pin passage and axis. In the illustrated embodiments, ball bearing 152 protrudes downward from hinge lug piece 130 and retention openings 127A-C are defined in an upward facing surface of hinge cup 120. In alternate embodiments, a ball bearing may protrude upward and engage retention openings defined in a downward facing surface. In still other embodiments, the ball bearing and sleeve are mounted to a hinge cup, with retention openings defined in a hinge lug piece surface.

Figure 10A:
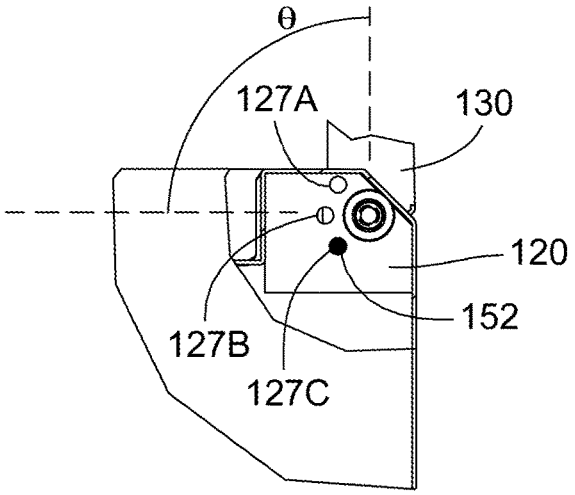
FIGS. 10A-C illustrate upward views of the hinge cup and hinge lug incorporating a retention mechanism in various angular positions.
Figure 10B:
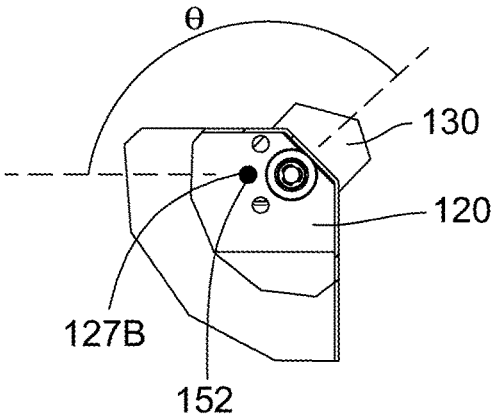
Figure 10C:
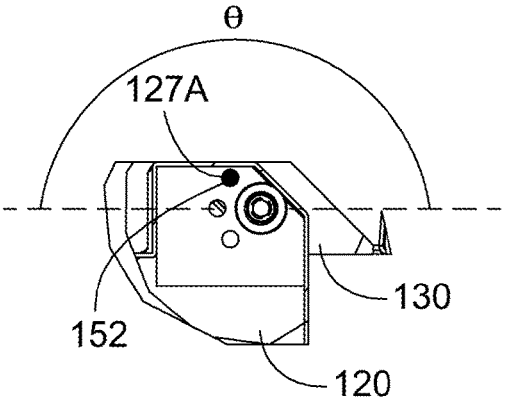

Once hinge assembly 110 is assembled, as door 40 and door lug piece 130 rotate, ball bearing 152 is sequentially rotated into alignment with retention openings 127A-C, as illustrated in FIGS. 10A-C. When ball bearing 152 reaches a position where it is aligned with one of the retention openings, ball bearing extends slightly into the retention opening. This creates a yielding resistance which urges door 40 to remain in place at the angle θ where the retention mechanism is engaged. Angle θ may be at a midpoint between a fully closed and fully open position. FIGS. 10A-C illustrate positions where hinge lug piece 130 has been rotated to approximately 90 degrees, approximately 135 degrees and approximately 180 degrees relative to the hinge cup 120. Other angular positions may be defined as desired. When sufficient rotational force is applied to the door, the retention force is overcome, allowing the door to be rotated further open or closed as desired. Specifically, when rotational force is applied to door 40, a shearing force is applied between ball bearing 152 and the respective retention opening. The shearing force urges the ball bearing 152 to slightly retract into sleeve 150, allowing the hinge lug piece 130 to rotate relative to hinge cup 120. Ball bearing 152 then remains slightly retracted and bears against a surface of hinge cup 120 until the ball bearing again comes into alignment with a retention opening.

While the disclosure has been illustrated and described in detail in the drawings and foregoing description, the same is to be considered as illustrative and not restrictive in character, it being understood that only the preferred example has been shown and described and that all changes, equivalents, and modifications that come within the spirit of the disclosures defined by following claims are desired to be protected.

What is claimed:

1. A secure storage unit, comprising:

a body assembly made of high strength and fire resistant material forming a storage cabinet with an interior defined by a right side, a top side, a left side, a lower side, a rear side, an open front and a frame surrounding the open front;

a pair of hinge cups defined within one side of the frame and extending partially behind the frame into the interior of the body assembly, each hinge cup including a rear wall with an upper end from which forwardly extends an upper plate and the rear wall has a lower end from which forwardly extends a parallel lower plate, and including a cylinder extending downward from the lower plate, wherein the cylinder defines a hinge pin passage with an opening wherein the hinge pin passage opening is only accessible from the interior of the body assembly;

a door sized to fit within the frame to close the open front;

a pair of hinge lug pieces fixedly secure to and extending from an edge of the door, each hinge lug piece including an upper plate, a parallel lower plate and a cylinder, wherein the cylinder defines a hinge pin passage;

wherein each hinge lug piece is received within a respective hinge cup cavity with the hinge lug piece upper plate and lower plate parallel to and received between the upper plate and the lower plate of the hinge cup and with the hinge pin passage in the hinge cup aligned with the hinge pin passage in the hinge lug piece;

a pair of hinge pins with each hinge pin arranged to extend within the aligned hinge pin passages in one of the hinge cups and a corresponding hinge lug piece to pivotally mount the door to the body assembly; and, wherein the hinge lug piece can pivot in a rotational range greater than 180 degrees relative to the frame.

2. The secure storage unit of claim 1, wherein the door can pivot in a rotational range of approximately 190 degrees or more relative to the frame.

3. The secure storage unit of claim 2, wherein when the door is closed, the hinge lug pieces are substantially flush with an exterior surface of the frame.

4. The secure storage unit of claim 1, wherein the upper plate and the lower plate of each hinge cup each have an exterior profile defined by at least an outer side, a forward side and an angled side extending between the outer side and the forward side and wherein the exterior of the frame has a profile matching at least the outer side, the forward side and the angled side of the upper plate and the lower plate.

5. The secure storage unit of claim 4, wherein each hinge lug piece includes at least three exterior sides with a profile matching the outer side, the forward side and the angled side of the hinge cup upper plate and lower plate.

6. The secure storage unit of claim 1, comprising a retention mechanism engaged between at least one of the hinge cups and a corresponding hinge lug piece, wherein the retention mechanism yieldingly holds the door open in at least one angular orientation between a fully open and a closed position.

7. The secure storage unit of claim 6, wherein the retention mechanism comprises a ball bearing biased to protrude from a sleeve mounted in the hinge lug piece; wherein the ball bearing is oriented to align with at least one retention opening defined in the corresponding hinge cup during rotation of the door; wherein when aligned the ball bearing engages the retention opening to yieldingly urge the door to remain at a specific angular position; and wherein when sufficient pressure is applied to the door, the ball bearing retracts within the sleeve allowing the door to rotate.

8. The secure storage unit of claim 7, wherein the hinge cup defines a series of retention openings wherein the ball bearing is oriented to sequentially align with the series of retention openings during rotation of the door to sequentially yieldingly urge the door to remain at a plurality of angular positions.

9. A hinge arrangement for a secure storage unit, comprising:

a hinge cup mounted to a frame defining an opening to a storage unit, the hinge cup defining a hinge pin passage;

a hinge lug piece extending from an edge of a door sized to fit within the frame to close the opening, the hinge lug piece arranged within the hinge cup and the hinge lug piece defining a hinge pin passage aligned with the hinge pin passage in the hinge cup;

a hinge pin arranged in the aligned passages in the hinge cup and hinge lug piece to pivotally mount the hinge lug piece to the hinge cup; and, wherein the hinge lug piece can pivot in a rotational range greater than 180 degrees relative to the hinge cup.

10. The arrangement of claim 9, wherein the hinge lug piece can pivot in a rotational range of 190 degrees or more relative to the hinge cup.

11. The arrangement of claim 9, wherein the hinge cup includes a forwardly extending upper plate and a forwardly extending parallel lower plate, wherein the hinge lug piece is received between the upper plate and the lower plate.

12. The arrangement of claim 11, wherein the upper plate and the lower plate each have an exterior cross-sectional profile defined by at least a side edge, a forward edge and an angled edge extending between the side edge and the forward edge and wherein the hinge lug piece includes at least three exterior sides with a profile matching the exterior cross-sectional profile of the side edge, forward edge and angled edge of the upper plate and the lower plate.

13. The arrangement of claim 9, comprising a retention mechanism engaged between the hinge cup and the hinge lug piece, wherein the retention mechanism yieldingly holds the door open in at least one angular orientation between a fully open and a closed position.

14. The arrangement of claim 13, wherein the retention mechanism comprises a ball bearing biased to protrude from a sleeve mounted to one of the hinge lug piece and the hinge cup; wherein the ball bearing is oriented to align with at least one retention opening defined in the other of the hinge lug piece and the hinge cup during rotation of the door; and wherein when aligned the ball bearing engages the retention opening to yieldingly urge the door to remain open at a specific angular orientation.

15. The arrangement of claim 14, comprising a series of retention openings wherein the ball bearing is oriented to sequentially align with the series of retention openings during rotation of the door to sequentially yieldingly urge the door to remain open at a plurality of angular orientations.

16. The arrangement of claim 14, wherein the hinge cup includes a pentagonal upper plate and a parallel pentagonal lower plate, and wherein the hinge lug piece includes a pentagonal upper plate and a parallel pentagonal lower plate of substantially the same size.

17. A secure storage unit, comprising:

a body assembly made of high strength and fire resistant material forming a storage cabinet with an interior defined by a right side, a top side, a left side, a lower side, a rear side and an open front;

a frame surrounding the open front, the frame cross-sectional profile having at least three exterior sides with a side edge, a forward edge and an angled edge extending between the side edge and the forward edge;

at least two hinge cups mounted in the frame, each hinge cup defining a hinge pin passage;

a door sized to fit within the frame to close the open front;

at least two hinge lug pieces extending from an edge of the door, each hinge lug piece defining a hinge pin passage;

wherein each hinge lug piece is sized and spaced to be received within a respective hinge cup with the hinge pin passage in each hinge cup aligned with the hinge pin passage in the hinge lug piece;

wherein the door is pivotally mounted to the body assembly by a pair of hinge pins respectively arranged in the aligned passages in each hinge cup and the respective hinge lug piece; and, wherein each hinge lug piece includes at least three exterior sides with a profile matching the profile of the at least three exterior sides of the frame.

18. The arrangement of claim 17, wherein when the door is closed, the at least three exterior sides of each hinge lug piece are substantially flush with the at least three exterior sides of the frame.

19. The arrangement of claim 17, wherein each hinge cup comprises a rear wall and, wherein the distance between a rotational axis of the hinge pin and the rear wall is greater than the distance between the rotational axis of the hinge pin and a forward exterior side of the hinge lug piece.

20. The arrangement of claim 17, wherein each hinge lug has an exterior profile defined by an outer side, a forward side and an angled side extending between the outer side and the forward side.

* * * * *